US009875675B2

(12) United States Patent
Okumoto

(10) Patent No.: US 9,875,675 B2
(45) Date of Patent: Jan. 23, 2018

(54) LIQUID CRYSTAL DISPLAY APPARATUS

(71) Applicant: Mitsubishi Electric Corporation, Tokyo (JP)

(72) Inventor: Kazunori Okumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 71 days.

(21) Appl. No.: 14/886,407

(22) Filed: Oct. 19, 2015

(65) Prior Publication Data

US 2016/0148549 A1 May 26, 2016

(30) Foreign Application Priority Data

Nov. 26, 2014 (JP) ..... 2014-238412

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 2300/0426* (2013.01)

(58) Field of Classification Search
None
See application file for complete search history.

(56) References Cited

U.S. PATENT DOCUMENTS 6,104,465 A * 8/2000 Na ..... G02F 1/1345 349/152
7,787,095 B2 * 8/2010 Lim ..... G02F 1/1345 349/145
8,089,598 B2 * 1/2012 Kim ..... G02F 1/136286 349/139
2006/0186913 A1 * 8/2006 Kim ..... G09G 3/006 324/760.02

FOREIGN PATENT DOCUMENTS

JP 2000-187451 A 7/2000

* cited by examiner

*Primary Examiner* — Paresh Patel
(74) *Attorney, Agent, or Firm* — Studebaker & Brackett PC

(57) ABSTRACT

A liquid crystal display apparatus includes a collective drive lighting inspection signal input wire that electrically connects a collective drive lighting inspection terminal to a plurality of gate wires and a plurality of source wires. The collective drive lighting inspection signal input wire includes a first wire corresponding to the gate wires and a second wire corresponding to the source wires. The first wire and the second wire each include a connection wire and a lead-out wire. The connection wire includes branch points connected to each of the plurality of gate wires or each of the plurality of source wires. The lead-out wire is led out from the connection wire to the collective drive lighting inspection terminal. The lead-out wire included in the first wire or the second wire includes a high-resistance region having a resistivity greater than a resistivity of the connection wire connected to the lead-out wire.

12 Claims, 7 Drawing Sheets

LIQUID CRYSTAL DISPLAY APPARATUS

BACKGROUND OF THE INVENTION

Field of the Invention

The present invention relates to a liquid crystal display apparatus, and more particularly, to a liquid crystal display apparatus that enables a collective drive lighting inspection.

Description of the Background Art

A technique for inspecting breaks in gate signal lines and source signal lines of semiconductor switching elements provided in a display region of a display panel and inspecting defects in pixels by lighting and non-lighting of the pixels in the display panel included in a liquid crystal display apparatus has been known. The inspection technique includes a technique, which has been known, for collectively inspecting a plurality of gate signal lines and a plurality of source signal lines by bringing an inspection needle into contact with an inspection terminal and for collectively controlling an input of an inspection signal to the gate signal lines and the source signal lines by a plurality of inspection semiconductor switching elements connected to the gate signal lines and the source signal lines.

Such collective inspection technique is different from an inspection technique for individually probing terminals of a plurality of gate signal lines and a plurality of source signal lines, and the collective inspection technique prevents an inspection device from influences of a resolution of the display panel and a design (such as the number of bumps) of a semiconductor chip, so that a general-purpose inspection at low cost can be achieved.

For the above-mentioned inspection technique, a lighting inspection circuit including the plurality of inspection semiconductor switching elements has been provided in a semiconductor chip mounting region in which a semiconductor chip is mounted. However, the semiconductor chip mounting region needs to be reduced in size due to a miniaturized semiconductor chip and a narrow frame of the display panel, so that the lighting inspection circuit is divided into a plurality of portions that are often provided in a region except for the semiconductor chip mounting region.

Upsizing and high resolution of a display panel in recent times causes distribution of a wiring resistance in a display plane, resulting in occurrence of display unevenness during the inspection by the collective control. To solve the concern of the display unevenness caused by the distribution of the wiring resistance in the display plane due to the upsizing and the high resolution of the display panel, Japanese Patent Application Laid-Open No. 2000-187451 has proposed a technique for adjusting lengths of wires to be equal in a lead-out region including the wires with different lengths to individually adjust the wiring resistance. The technique is applied to the plurality of wires that electrically connect a display portion to a semiconductor chip portion, and thus effects can be obtained in a drive (normal drive) method during manufacturing, and the display unevenness caused by the distribution of the wiring resistance can be prevented.

However, when wires in a collective drive inspection circuit are different from the plurality of wires to which the above-mentioned technique is applied, the display unevenness caused by the distribution of the wiring resistance may occur during the collective drive even in the display panel in which the display unevenness is prevented during the normal drive. The difference between the groups of the wires here is that the plurality of wires are completely independent of each other and have different resistances between the wires while the wires in the collective drive inspection circuit are a plurality of wires branching off from one common wire and the plurality of branched wires have approximately the same resistance. In other words, the common wire portion causes the distribution of the wiring resistance in the collective drive inspection circuit, so that the display unevenness fails to be improved by individually adjusting the wires as proposed in Japanese Patent Application Laid-Open No. 2000-187451.

SUMMARY OF THE INVENTION

It is an object of the present invention to provide a liquid crystal display apparatus that suppresses occurrence of display unevenness during a lighting inspection by a collective drive control.

A liquid crystal display apparatus includes: a plurality of gate wires arranged in parallel in a display region; a plurality of source wires that are arranged in parallel in the display region and intersect the plurality of gate wires; a collective drive lighting inspection terminal located in a frame region; and a collective drive lighting inspection signal input wire that is located in the frame region and electrically connects the collective drive lighting inspection terminal to the plurality of gate wires and the plurality of source wires. The collective drive lighting inspection signal input wire includes a first wire corresponding to the gate wires and a second wire corresponding to the source wires. The first wire and the second wire each include a connection wire and a lead-out wire, the connection wire including branch points connected to each of the plurality of gate wires or each of the plurality of source wires, the lead-out wire being led out from the connection wire to the collective drive lighting inspection terminal. The lead-out wire included in the first wire or the lead-out wire included in the second wire includes a high-resistance region having a resistivity greater than a resistivity of the connection wire connected to the lead-out wire.

In the liquid crystal display apparatus according to the present invention, the lead-out wire without the branch points has a resistivity greater than a resistivity of the connection wire including the branch points in the collective drive lighting inspection signal input wire. This configuration can reduce distribution of the wiring resistance in the collective drive lighting inspection signal input wire. Thus, the display unevenness of pixels can be reduced during the collective drive lighting inspection.

These and other objects, features, aspects and advantages of the present invention will become more apparent from the following detailed description of the present invention when taken in conjunction with the accompanying drawings.

DESCRIPTION OF THE PREFERRED EMBODIMENTS

First Preferred Embodiment

Figure 1:
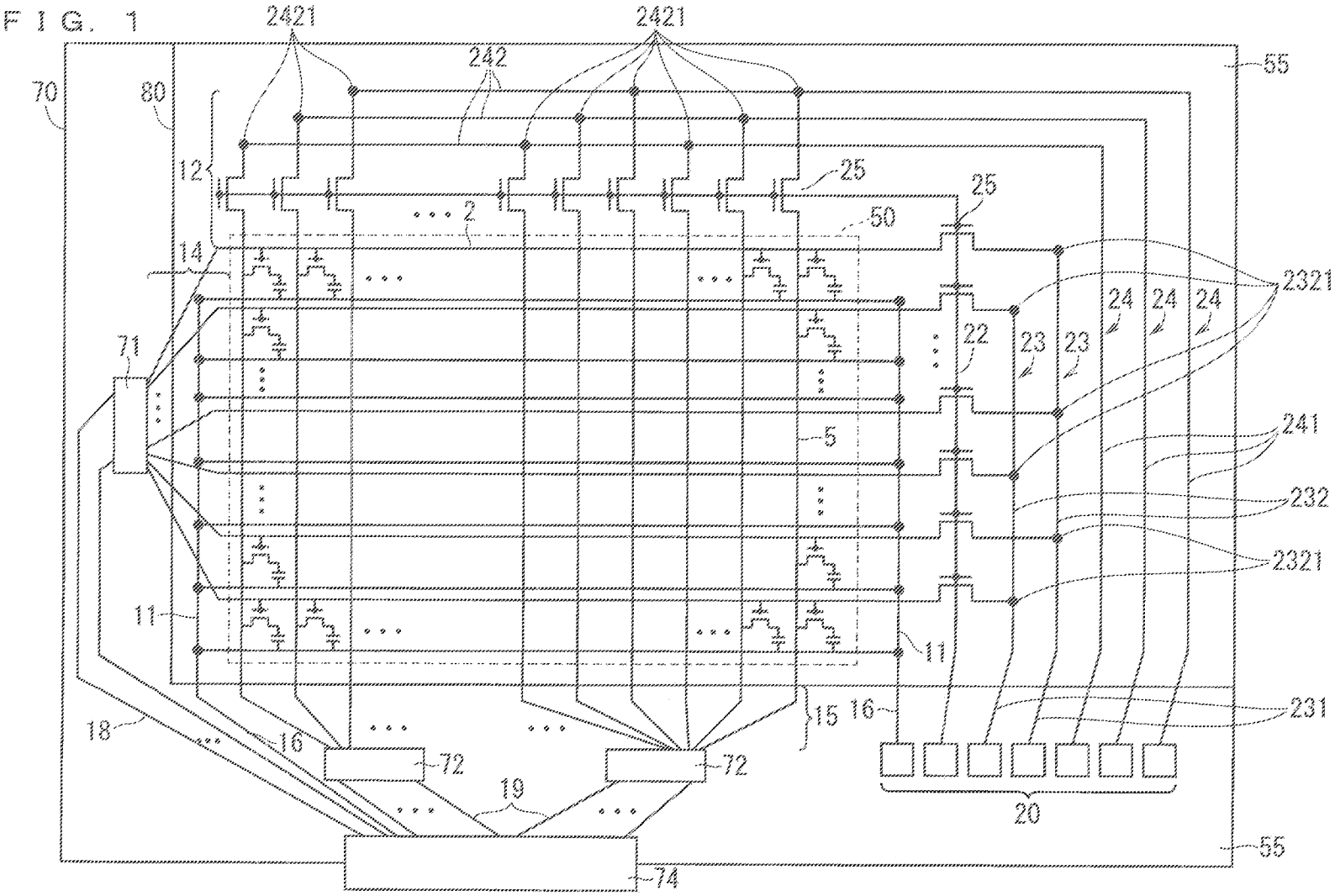
FIG. 1 is a plan view of a liquid crystal display apparatus according to a first preferred embodiment.
Figure 2:
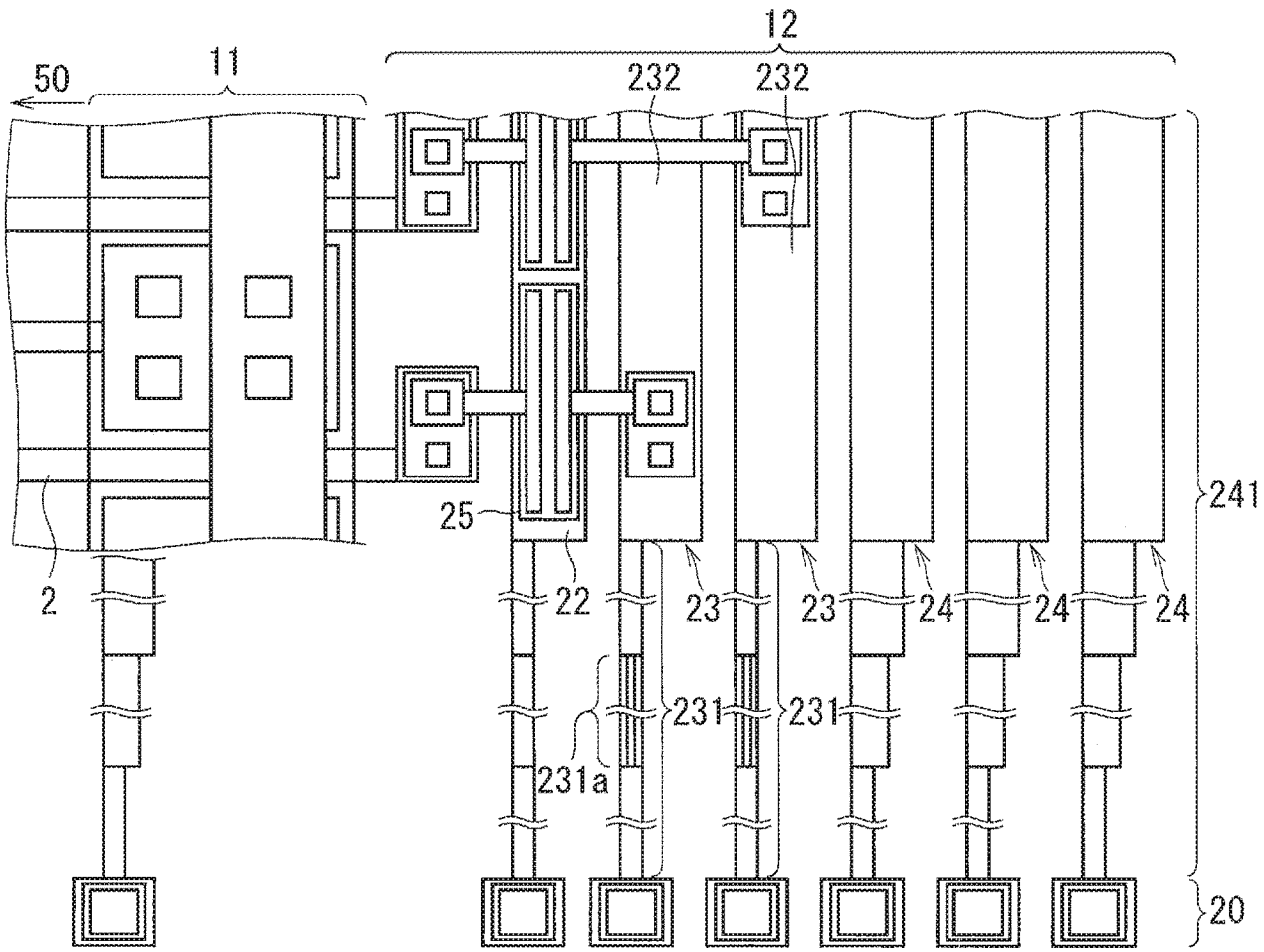
FIG. 2 is a partially enlarged view of a collective drive lighting inspection circuit of the liquid crystal display apparatus according to the first preferred embodiment.

FIG. 1 is a plan view showing a configuration of a liquid crystal display apparatus according to a first preferred embodiment. FIG. 2 is a partially enlarged view of a collective drive lighting inspection circuit 12 of the liquid crystal display apparatus according to the first preferred embodiment. The same or similar components of display devices according to other preferred embodiments are denoted by the same references of the components of the liquid crystal display apparatus according to the first preferred embodiment shown in FIG. 1.

As shown in FIG. 1, a plurality of pixels being display units of an image are provided in a display region 50 indicated by dotted lines. A thin film transistor (TFT) being a switching element that supplies display voltage to a pixel electrode is disposed in each of the pixels. A member formed of a substrate on which the TFTs are mounted is referred to as a TFT array substrate 70. The TFT array substrate 70 includes the TFTs in each of the pixels, the TFTs being arranged in matrix.

A plurality of gate wires 2 (namely, scanning signal lines) are arranged in parallel in the display region 50 of the TFT array substrate 70. Moreover, a plurality of source wires 5 (namely, display signal lines) are formed in the display region 50 and intersect the plurality of gate wires 2. A region surrounded by a pair of adjacent gate wires 2 and a pair of adjacent source wires 5 corresponds to a unit pixel. Thus, the pixels are arranged in matrix in the display region 50.

The TFT array substrate 70 and a counter substrate 80 are bonded with a seal while including liquid crystals sealed therebetween. A frame region 55 is disposed around the display region 50 of each of the TFT array substrate 70 and the counter substrate 80 while surrounding the display region 50. A gate wire driving circuit 71, source wire driving circuits 72, and a flexible substrate 74 are mounted in the frame region 55 of the TFT array substrate 70 being an exposed region without the counter substrate 80. Furthermore, a plurality of collective drive lighting inspection terminals 20 are disposed in the frame region 55 of the TFT array substrate 70 being the exposed region.

The gate wire driving circuit 71 and the source wire driving circuits 72 are electrically connected to the flexible substrate 74 by gate IC input wires 18 and source IC input wires 19, respectively. The gate wire driving circuit 71 is electrically connected to the gate wires 2 in the display region 50 by gate wire lead-out wires 14. The source wire driving circuits 72 are electrically connected to the source wires 5 in the display region 50 by source wire lead-out wires 15.

As shown in FIG. 1, the collective drive lighting inspection circuit 12 is disposed in the frame region 55 opposite to the gate wire driving circuit 71 or the source wire driving circuits 72. The collective drive lighting inspection circuit 12 includes the plurality of collective drive lighting inspection terminals 20, a plurality of collective drive lighting inspection signal input wires 23, 24, and a plurality of collective drive lighting inspection thin-film transistors 25 (hereinafter may be also referred to as collective drive lighting inspection TFTs 25). The collective drive lighting inspection signal input wires 23 each electrically connect one of the collective drive lighting inspection terminals 20 to the plurality of gate wires 2. The plurality of gate wires 2 and each of the collective drive lighting inspection signal input wires 23 are connected through the collective drive lighting inspection TFTs 25. The collective drive lighting inspection signal input wires 24 each electrically connect one of the collective drive lighting inspection terminals 20 to the plurality of source wires 5. The plurality of source wires 5 and each of the collective drive lighting inspection signal input wires 24 are connected through the collective drive lighting inspection TFTs 25.

As shown in FIG. 1, the collective drive lighting inspection signal input wires 23 corresponding to the gate wires 2 have a wiring length shorter than a wiring length of the collective drive lighting inspection signal input wires 24 corresponding to the source wires 5. Hereinafter, the collective drive lighting inspection signal input wires 23 that are relatively short are also referred to as first wires. The collective drive lighting inspection signal input wires 24 that are relatively long are also referred to as second wires.

The concern here is display unevenness caused by distribution of a wiring resistance in a display plane due to upsizing and high resolution of the display panel. To solve the concern, a technique for adjusting lengths of wires to be equal in a lead-out region including the wires with different lengths to individually adjust the wiring resistance has been known.

The display unevenness occurs on the gate wire driving circuit 71 side in the display region 50. In the direction of the source wires, the display unevenness is often visually identified in the positions of the gate wire lead-out wires 14 having low resistance correspondingly to the distribution of the resistance in the gate wire lead-out wires 14 that connect the gate wire driving circuit 71 to the gate wires 2 in the display region 50. In other words, the display unevenness results from the distribution in the panel in which the gate signals delay, so that the difference in the resistance in the gate wire lead-out wires 14 needs to be reduced as a measure.

Therefore, the technique is applied to the gate wire lead-out wires 14, and the gate wire lead-out wires 14 are disposed so as to set a resistance value in which the display unevenness does not occur, and thus the occurrence of the display unevenness can be suppressed during the normal drive. A minimum value and a maximum value of the wiring resistance in the gate wire lead-out wires 14 at this time are R1 and R2, respectively.

However, the wires in the collective drive lighting inspection circuit 12 are different from the above-mentioned plurality of wires to which the technique is applied, so that the display unevenness caused by the distribution of the wiring resistance may occur during a collective drive lighting inspection even in the display panel in which the display unevenness is suppressed during the normal drive.

Here, a position of the occurrence of the display unevenness during the collective drive is different from a position of the occurrence of the display unevenness that may occur during the normal drive, and the display unevenness often occurs in a corner portion of the display region 50 on the side close to the collective drive lighting inspection terminals 20.

Therefore, also in this case, similarly to the gate wire lead-out wires 14, it is conceivable that the difference in the resistance in the panel plane of the wires (namely, the collective drive lighting inspection signal input wires 23) that connect the collective drive lighting inspection terminals 20 to the gate wires 2 in the display region 50 needs to be reduced as the measure.

Here, the collective drive lighting inspection signal input wires 23 (namely, the first wires) that input gate signals from the collective drive lighting inspection terminals 20 to the display region 50 each include a connection wire 232 and a lead-out wire 231. The connection wire 232 includes branch points 2321 connected to each of the gate wires 2. The lead-out wire 231 is led out from the connection wire 232 to the collective drive lighting inspection terminal 20. Here, the first wire is connected to each of the gate wires 2 by a branched wire between each of the branch points of the connection wire 232 and each of the gate wires 2. The branched wire includes the collective drive lighting inspection TFT 25 in part of the branched wire.

Similarly, the collective drive lighting inspection signal input wires 24 (namely, the second wires) that input source signals from the collective drive lighting inspection terminals 20 to the display region 50 each include a connection wire 242 and a lead-out wire 241. The connection wire 242 includes branch points 2421 connected to each of the source wires 5. The lead-out wire 241 is led out from the connection wire 242 to the collective drive lighting inspection terminal 20. Here, the second wire is connected to each of the source wires 5 by a branched wire between each of the branch points of the connection wire 242 and each of the source wires 5. The branched wire includes the collective drive lighting inspection TFT 25 in part of the branched wire.

The branched wires have a small difference in resistance, so that the plurality of branched wires do not have the distribution of the resistance in the panel plane. In other words, the distribution of the wiring resistance in the collective lighting inspection circuit 12 results from the collective drive lighting inspection signal input wires 23 being common wires. Thus, the technique for changing the above-mentioned resistance values of the gate wire lead-out wires 14 to reduce the distribution of the resistance between the gate wire lead-out wires 14 is applied to the branched wires, which produces no effects.

Then, this preferred embodiment proposes a technique for designing a wiring resistance by dividing each of the collective drive lighting inspection signal input wires 23 (namely, the first wires) into a region (lead-out wire 231) from the collective drive lighting inspection terminal 20 to the closest branched wire and a region (connection wire 232) disposed close to the display region 50 in the direction of the source wires 5, to thereby reduce the distribution of the wiring resistance in the collective drive lighting inspection circuit 12.

In the first preferred embodiment, a high-resistance region 231*a* included in the lead-out wire 231 has a resistivity greater than a resistivity of the connection wire 232 in the collective drive lighting inspection signal input wire 23 (namely, the first wire). Specifically, as shown in FIG. 2, the high-resistance region 231*a* included in the lead-out wire 231 has a wiring width designed to be narrower than a wiring width of the connection wire 232 in the collective drive lighting inspection signal input wire 23 (namely, the first wire). In the first preferred embodiment, the lead-out wire 231 has a wiring width designed to be narrower than a wiring width of the lead-out wire 241. The wiring width of the lead-out wire 231 is determined such that the first wire has a wiring resistance of R1 or more. The wiring width of the connection wire 232 is determined such that the first wire has a wiring resistance of R2 or less. Here, for example, the wiring resistance in the first wire represents a resistance value in a wiring path from one end to the other end, the wiring path being the connection wire 232 and the lead-out wire 231.

As shown in FIG. 2, in the first preferred embodiment, a slit is provided in part of the lead-out wire 231 in the high-resistance region 231*a* to narrow the wiring width of the lead-out wire 231. The first preferred embodiment is characterized in that the lead-out wire 231 has the wiring width narrower than the wiring width of the lead-out wire 241.

The lead-out wire 231 has the narrow wiring width, so that the minimum value of the wiring resistance in the collective drive lighting inspection circuit 12 can be adjusted so as to be R1 or more, the collective drive lighting inspection circuit 12 inputting the gate signals from the collective drive lighting inspection terminals 20 to the display region 50.

Meanwhile, the maximum value of the wiring resistance in the collective drive lighting inspection circuit 12 also increases, the collective drive lighting inspection circuit 12 inputting the gate signals from the collective drive lighting inspection terminals 20 to the display region 50. Thus, the maximum value of the wiring resistance in the collective drive lighting inspection circuit 12 is adjusted so as to be R2 or less by increasing the wiring width of the connection wire 232 more than that of the lead-out wire 231, the collective drive lighting inspection circuit 12 inputting the gate signals from the collective drive lighting inspection terminals 20 to the display region 50.

In other words, the lead-out wire 231 has the wiring width narrower than that of the connection wire 232, so that the distribution of the resistance in the wires (namely, the first wires) in the collective drive lighting inspection circuit 12 can be suppressed to a desired value or less, the collective drive lighting inspection circuit 12 inputting the gate signals from the collective drive lighting inspection terminals 20 to the display region 50. Consequently, the display unevenness of the screen during a collective drive lighting inspection can be suppressed.

It is feared that breaks caused by thinning of the lead-out wire 231 reduce yields, but wires having a slit structure are employed in the high-resistance region 231*a* in the first preferred embodiment. Thus, the effect of suppressing the reduction in yield due to the redundant wires as well as the effect of increasing the resistance can be obtained.

In the collective drive lighting inspecting signal input wire 24 (namely, the second wire) corresponding to the source wires 5, the connection wire 242 including the plurality of branch points is disposed opposite to the collective drive lighting inspection terminals 20 and the display region 50. Thus, the lead-out wire 241 in the second wire has the wiring length extremely longer than the wiring length of the lead-out wire 231 in the first wire. Therefore, the lead-out wire 241 in the second wire has the wiring width designed to be greater than the wiring width of the lead-out wire 231 in the first wire, and thus a wiring resistance in the lead-out wire 241 in the second wire can be reduced.

<Effects>

The liquid crystal display apparatus in the first preferred embodiment includes the display region 50 that displays an image and the frame region 55 that surrounds the display region 50. The liquid crystal display apparatus includes: the plurality of gate wires 2 arranged in parallel in the display region 50; the plurality of source wires 5 that are arranged in parallel in the display region 50 and intersect the plurality of gate wires 2; the collective drive lighting inspection terminal 20 located in the frame region 55; and the collective drive lighting inspection signal input wire 23, 24 that is located in the frame region 55 and electrically connects the collective drive lighting inspection terminal 20 to the plurality of gate wires 2 and the plurality of source wires 5. The collective drive lighting inspection signal input wire 23, 24 includes the first wire corresponding to the gate wires 2 and the second wire corresponding to the source wires 5. The first wire and the second wire each include the connection wire 232, 242 and the lead-out wire 231, 241, the connection wire 232, 242 including the branch points connected to each of the plurality of gate wires 2 or each of the plurality of source wires 5, the lead-out wire 231, 241 being led out from the connection wire 232, 242 to the collective drive lighting inspection terminal 20. The lead-out wire 231 included in the first wire or the lead-out wire 241 included in the second wire includes the high-resistance region 231*a* having a resistivity greater than a resistivity of the connection wire 232, 242 connected to the lead-out wire 231, 241.

Therefore, the high-resistance region 231*a* included in the lead-out wire 231 without the branch points has the resistivity greater than the resistivity of the connection wire 232 including the branch points in the first wire (namely, the collective drive lighting inspection signal input wire 23) corresponding to the gate wires 2. This configuration can reduce the distribution of the wiring resistance in the collective drive lighting inspection circuit 12 on the gate side in which the distribution of the wiring resistance is relatively great. Thus, the display unevenness of the pixels can be reduced during the collective drive lighting inspection.

In the liquid crystal display apparatus in the first preferred embodiment, the high-resistance region 231*a* included in the lead-out wire 231 is a region having the wiring width narrower than that of the connection wire 232 connected to the lead-out wire 231.

The liquid crystal display apparatus in the first preferred embodiment further includes the plurality of gate wire lead-out wires 14 that electrically connect the gate wire driving circuit 71 to the ends of the plurality of gate wires 2, the gate wire driving circuit 71 generating a drive signal to the gate wires 2 during the normal drive, the ends being opposite to the side connected to the first wire. The lead-out wire 231 included in the first wire includes the high-resistance region 231*a*. The first wire including the high-resistance region 231*a* has the wiring resistance greater than the minimum value R1 of the wiring resistance of each of the plurality of gate wire lead-out wires 14.

Therefore, the first wire can have the wiring resistance greater than the minimum value R1 of the wiring resistance of each of the gate wire lead-out wires 14 by adjusting the resistance value of the high-resistance region 231*a*. Moreover, distribution of a wiring resistance on the gate side that transmits a switching pulse signal is easily visually identified as unevenness. Further, broad local distribution of a wiring resistance is easily visually identified as unevenness. An amount of change in an absolute value of the wiring resistance caused by the distribution of the wiring resistance is relatively broad particularly on a lower limit side of the resistance, and thus the local distribution also increases. Therefore, to reduce the local distribution of the wiring resistance, it is effective to set the absolute value of the resistance particularly on the lower limit side, namely, the lower limit value of the wiring resistance to be great. In the liquid crystal display apparatus in the first preferred embodiment, the minimum value R1 of the wiring resistance in the gate wire lead-out wires 14 that also transmit the switching pulse signal is appropriately designed to be greater than or equal to the lower limit value in which no display unevenness occurs, to thereby prevent occurrence of the display unevenness when an image is displayed during the normal drive. Therefore, also in the collective drive lighting inspection circuit 12, the minimum value R1 of the wiring resistance can be used as a guideline for the lower limit of the wiring resistance on the gate side to prevent the occurrence of the display unevenness. As described above, in the liquid crystal display apparatus in the first preferred embodiment, the first wire corresponding to the gate wires 2 has the wiring resistance greater than the minimum value R1 of the wiring resistance of each of the gate wire lead-out wires 14, which reliably prevents the occurrence of the display unevenness caused by the local distribution of the resistance value on the gate side, the local distribution being the easiest to be visually identified. This can prevent the occurrence of the unevenness more effectively.

In the liquid crystal display apparatus in the first preferred embodiment, the first wire including the high-resistance region 231*a* has the wiring resistance smaller than the maximum value R2 of the wiring resistance of each of the plurality of gate wire lead-out wires 14.

Therefore, the first wire can have the wiring resistance smaller than the maximum value R2 of the wiring resistance of each of the gate wire lead-out wires 14 by increasing the wiring width of the connection wire 232 included in the first wire. In the liquid crystal display apparatus in the first preferred embodiment, the minimum value R1 and the maximum value R2 of the wiring resistance in the gate wire lead-out wires 14 that also transmit the switching pulse signal are appropriately designed to be within a range of the distribution of the resistance in which no display unevenness occurs to prevent the occurrence of the display unevenness when an image is displayed during the normal drive. Therefore, also in the collective drive lighting inspection circuit 12, the minimum value R1 and the maximum value R2 of the wiring resistance can be used as a guideline for the upper limit and the lower limit of the distribution of the wiring resistance on the gate side to prevent the occurrence of the display unevenness. Thus, in the liquid crystal display apparatus in the first preferred embodiment, the first wire corresponding to the gate wires 2 has the wiring resistance greater than the minimum value R1 of the wiring resistance of each of the gate lead-out wires 14, and furthermore, the first wire has the wiring resistance smaller than the maximum value R2, which reliably prevents the occurrence of the display unevenness caused by the distribution of the resistance value on the gate side that is easily visually identified. This can prevent the occurrence of the unevenness more effectively. The resistance of each of the gate lead-out wires 14 for display whose design technique has already been established is appropriately set within the range, and the resistance of the gate lead-out wire 14 is used as a guidance for reliably preventing the occurrence of the display unevenness, so that the collective drive lighting inspection circuit 12 that obtains the effects above can be easily designed.

Therefore, if the materials for the lead-out wire 231 and the connection wire 232 are the same, for example, narrowing the wiring width of the lead-out wire 231 can increase the wiring resistance of the lead-out wire 231 greater than the wiring resistance of the connection wire 232.

In the liquid crystal display apparatus in the first preferred embodiment, the lead-out wire 231 included in the first wire includes the high-resistance region 231*a*, and the high-resistance region 231*a* of the lead-out wire 231 included in the first wire is a region having the wiring width narrower than that of the lead-out wire 241 included in the second wire.

Therefore, a difference in the wiring resistance between the two lead-out wires 231, 241 can be reduced by narrowing the wiring width of the lead-out wire 231 that is relatively short narrower than the wiring width of the lead-out wire 241 that is relatively long. Thus, the difference in the wiring resistance between the first wire and the second wire can be reduced.

In the liquid crystal display apparatus in the first preferred embodiment, the high-resistance region 231*a* included in the lead-out wire 231 is a region in which a slit is provided in the lead-out wire 231.

Therefore, the slit is provided in the lead-out wire 231, so that reliability of broken wires can be improved by increasing the number of wires with thinning of the wires.

In addition, the collective drive lighting inspection terminals 20 are provided close to the gate wires 2 as shown in FIG. 1, so that the first wires are shorter than the second wires. Consequently, the lead-out wire 231 has the wiring resistance greater than that of the connection wire 232 in the first wire, so that the distribution of the wiring resistance in the first wire can be particularly effectively reduced.

Second Preferred Embodiment

Figure 3:
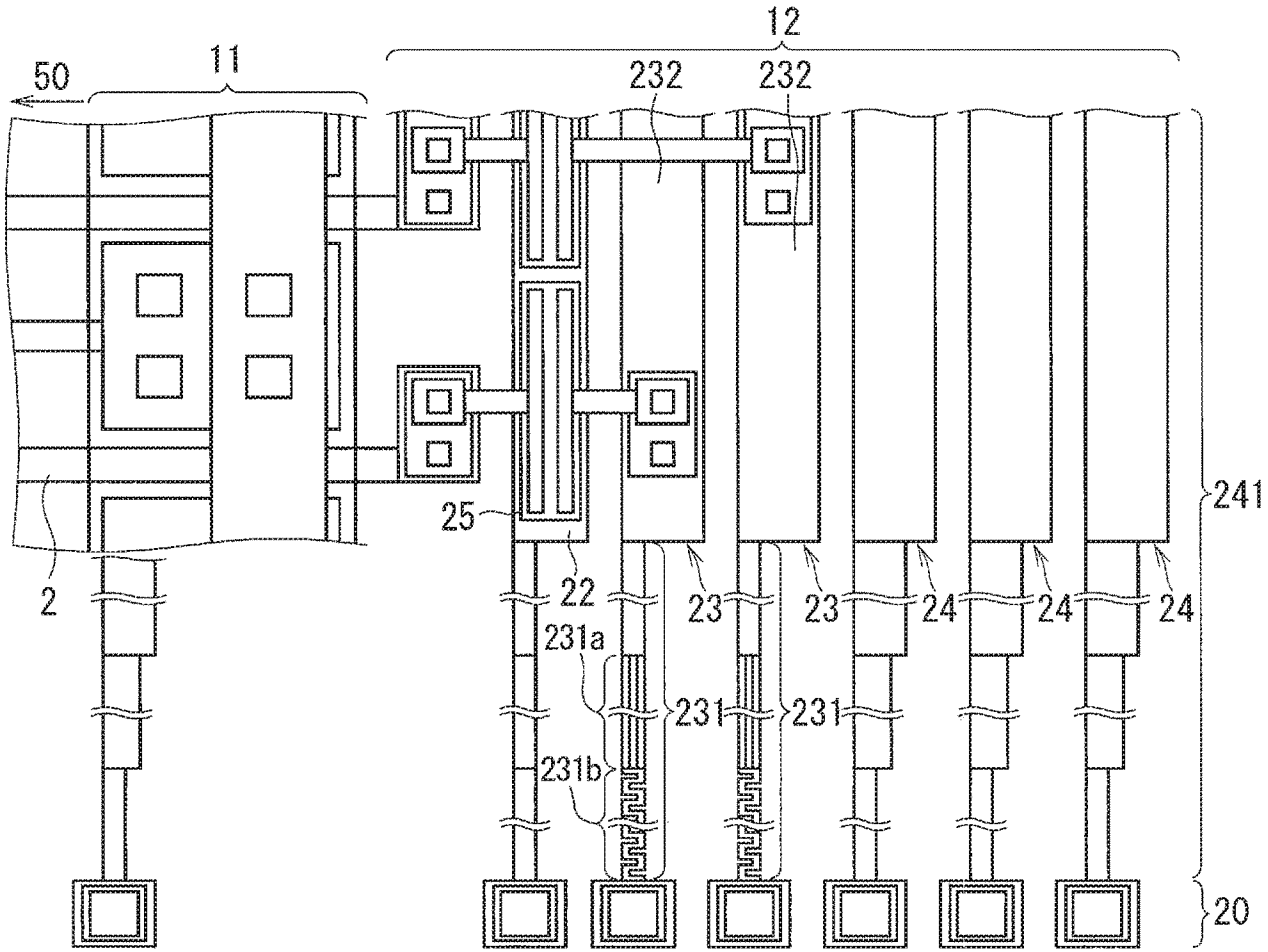
FIG. 3 is a partially enlarged view of a collective drive lighting inspection circuit of a liquid crystal display apparatus according to a second preferred embodiment.

FIG. 3 is a partially enlarged view of a collective drive lighting inspection circuit 12 of a liquid crystal display apparatus according to a second preferred embodiment. In the second preferred embodiment, as shown in FIG. 3, the lead-out wire 231 of the collective drive lighting inspection signal input wire 23 (namely, the first wire) in the first preferred embodiment (FIG. 2) further includes a high-resistance region 231*b* including a wire in a zigzag pattern.

Part of the lead-out wire 231 has the zigzag pattern, so that a minimum value of a wiring resistance in the lead-out wire 231 can be adjusted so as to be R1 or more by increasing the wiring resistance thereof.

The adjustment of the resistance value by the wiring width as described in the first preferred embodiment has a limitation of the wiring width that can be manufactured, so that the increase in resistance is limited. On the other hand, the adjustment of the resistance by the length of the wire in the zigzag pattern can be compatible with the increase in resistance to the limit of an installation region without manufacturing limitations. Thus, the resistance value is adjusted by the zigzag wire in the wider adjustment range than the adjustment range of the resistance value by the wiring width.

In the second preferred embodiment, the wires in the zigzag pattern are only employed in the lead-out wires 231 corresponding to the gate wires 2. Furthermore, by locating the collective drive lighting inspection terminals 20 such that the lead-out wires 241 corresponding to the source wires 5 have the shorter wiring length, an adjustment of the resistance in the wires (namely, the first wires) in the collective drive lighting inspection circuit 12 and a reduction in resistance in the lead-out wires 241 of the collective drive lighting inspection signal input wires 24 can be simultaneously achieved, the collective drive lighting inspection circuit 12 inputting the gate signals from the collective drive lighting inspection terminals 20 to the display region 50.

<Effect>

In the liquid crystal display apparatus in the second preferred embodiment, the high-resistance region 231*b* included in the lead-out wire 231 includes the wire in a zigzag pattern.

Therefore, the wiring resistance in the lead-out wire 231 can be adjusted by adjusting the length of the wire in the zigzag pattern.

Third Preferred Embodiment

Figure 4:
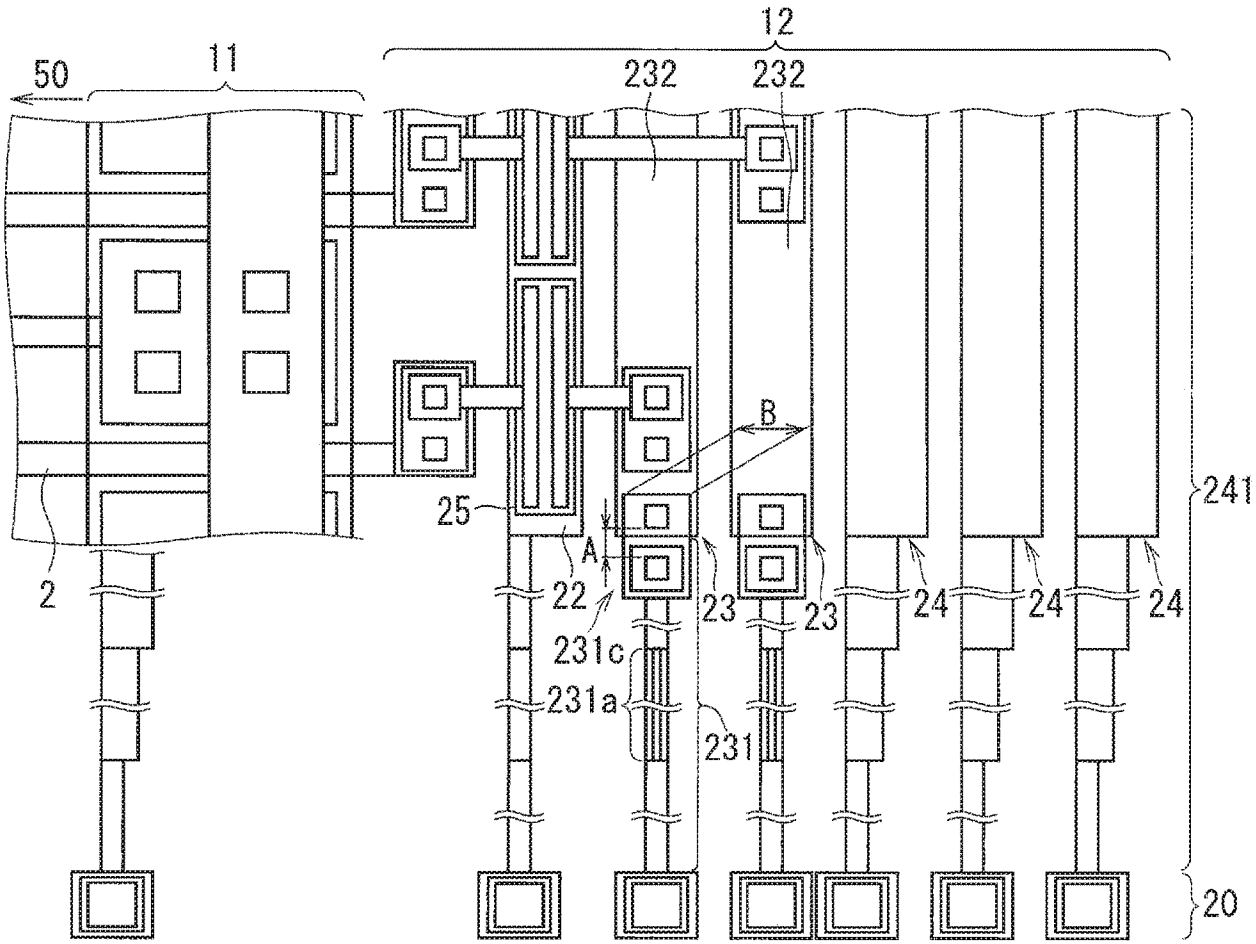
FIG. 4 is a partially enlarged view of a collective drive lighting inspection circuit of a liquid crystal display apparatus according to a third preferred embodiment.

FIG. 4 is a partially enlarged view of a collective drive lighting inspection circuit 12 of a liquid crystal display apparatus according to a third preferred embodiment. As shown in FIG. 4, the third preferred embodiment further includes a high-resistance region (namely, a connection converter 231*c*) that connects the connection wire 232 to the lead-out wire 231 included in the first wire corresponding to the gate wires 2 in the first preferred embodiment (FIG. 2). In the connection converter 231*c*, a conductive layer (for example, a transparent conductive film) having a high resistance connects the connection wire 232 to the lead-out wire 231.

In the connection converter 231*c*, a distance A between converters is increased to increase a length of a wire in the conductive layer, and thus the resistance in the connection converter 231*c* can be increased. Moreover, a width B of the wire in the conductive layer is reduced, and thus the resistance in the connection converter 231*c* can be increased.

In the third preferred embodiment, a contact resistance in the connection converter 231*c* and a resistance in the transparent conductive film are added as the wiring resistance in the lead-out wire 231. Thus, a minimum value of a wiring resistance in the collective drive lighting inspection circuit 12 can be adjusted so as to be R1 or more, the collective drive lighting inspection circuit 12 inputting the gate signals from collective drive lighting inspection terminals 20 to a display region 50.

In the third preferred embodiment, the connection converter 231*c* is only employed on the lead-out wires 231 side corresponding to the gate wires 2. Furthermore, by locating the collective drive lighting inspection terminals 20 such that the lead-out wires 241 corresponding to the source wires 5 have the shorter wiring length, an adjustment of the resistance in the wires (namely, the first wires) in the collective drive lighting inspection circuit 12 and a reduction in resistance in the lead-out wires 241 of the collective drive lighting inspection signal input wires 24 can be simultaneously achieved, the collective drive lighting inspection circuit 12 inputting the gate signals from the collective drive lighting inspection terminals 20 to the display region 50.

<Effect>

In the liquid crystal display apparatus in the third preferred embodiment, the high-resistance region included in the lead-out wire 231 is the connection converter 231*c* that connects the lead-out wire 231 to the connection wire 232, 242 included in the first wire or the second wire.

Therefore, the wiring resistance in the lead-out wire 231 including the connection converter 231*c* can be adjusted by adjusting the contact resistance in the connection converter 231*c* and the length and the width of the conductive film of the connection converter 231*c*. In comparison with a means of adjusting a resistance by a wire itself having a low resistance, the means of adjusting the resistance by the contact resistance, in particular, of the connection converter 231*c* used in the third preferred embodiment can adjust a resistance value in a wide range in a relatively small installation region. The means is thus suitable to be used as a means of adjusting the resistance in the collective drive lighting inspection circuit 12 under the constraint that the collective drive lighting inspection circuit 12 needs to be disposed in a small region.

Modification of Third Preferred Embodiment

Figure 5:
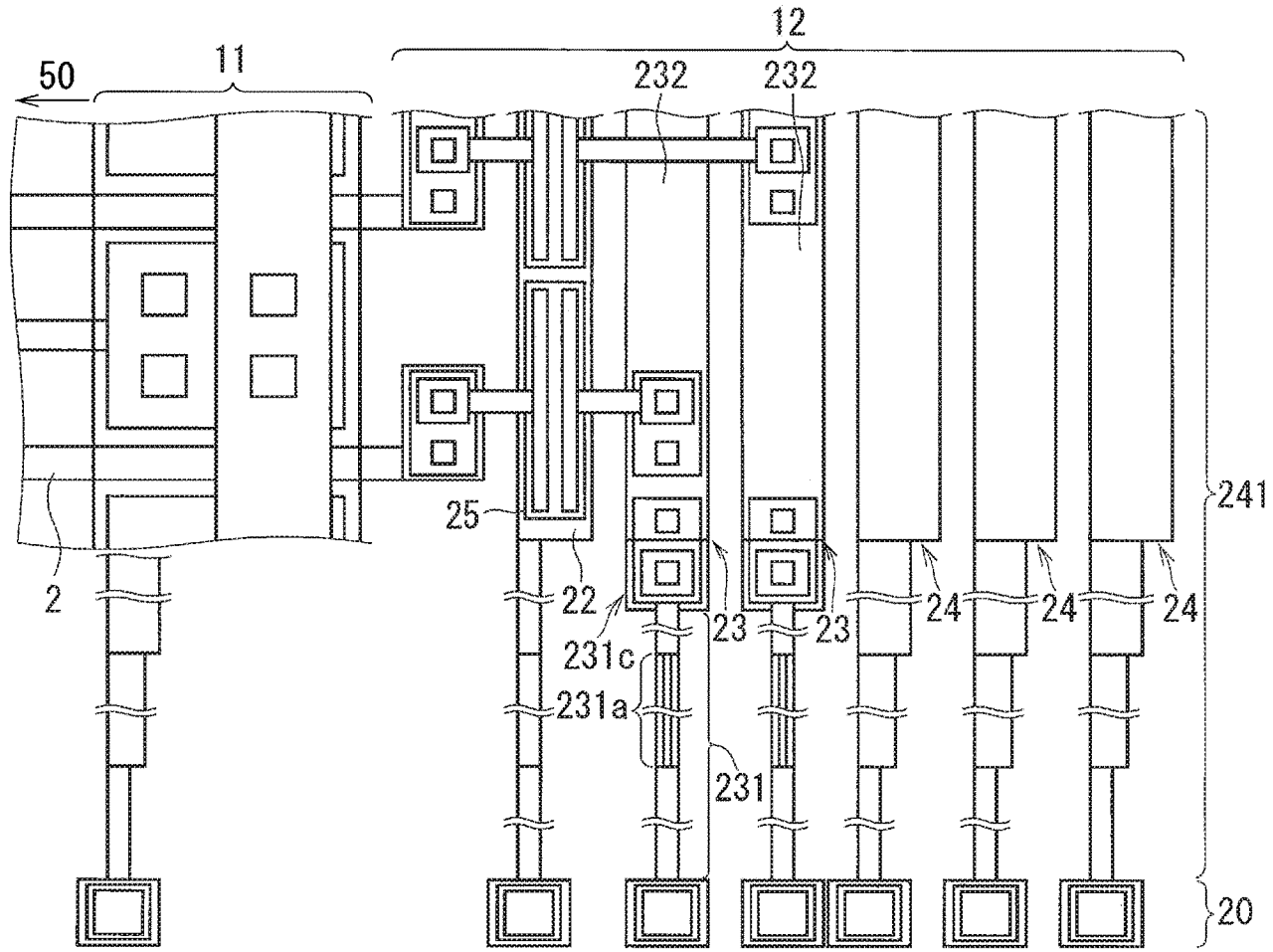
FIG. 5 is a partially enlarged view of a collective drive lighting inspection circuit of a liquid crystal display apparatus according to a modification of the third preferred embodiment.

FIG. 5 is a partially enlarged view of a collective drive lighting inspection circuit 12 of a liquid crystal display apparatus according to a modification of the third preferred embodiment. With reference to FIG. 5, the modification of the third preferred embodiment is described. In the modification, the high-resistance region 231*a* included in the lead-out wire 231 in the first wire is made of a material having a resistivity greater than that of the connection wire 232 connected to the lead-out wire 231. In addition, the whole lead-out wire 231 may be made of the material having the resistivity greater than that of the connection wire 232. In this case, the lead-out wire 231 and the connection wire 232 that are made of different wiring materials are electrically connected by the connection converter 231*c*.

Therefore, the lead-out wire 231 is formed of the material having the resistivity greater than that of the connection wire 232 in the first wire corresponding to the gate wires 2, allowing an adjustment to a minimum value of a resistance in the wire (namely, the first wire) in the collective drive lighting inspection circuit 12 that inputs the gate signals from the collective drive lighting inspection terminals 20 to the display region 50. The means of adjusting resistance by using the materials having the different resistivity for each of the wires in the modification can adjust a resistance value in a relatively small installation region. The means is thus suitable to be used as a means of adjusting the resistance in the collective drive lighting inspection circuit 12 under the constraint that the collective drive lighting inspection circuit 12 needs to be disposed in a small region.

Fourth Preferred Embodiment

Figure 6:
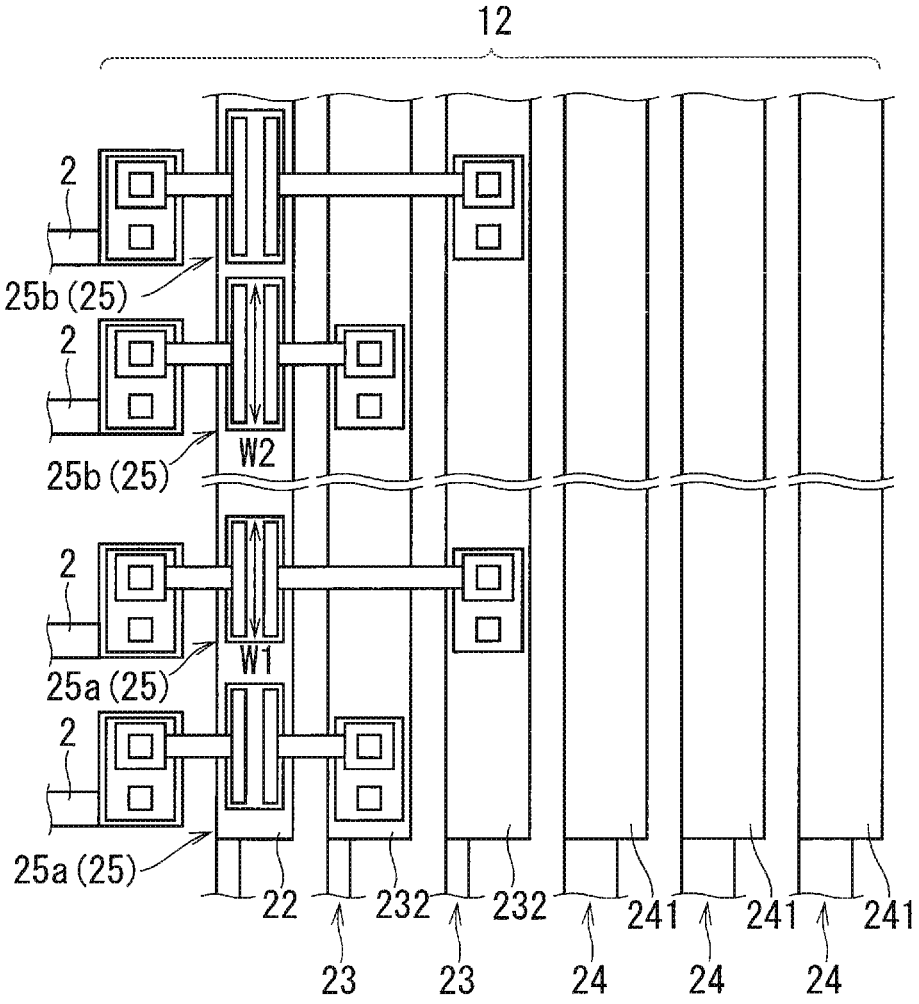
FIG. 6 is a partially enlarged view of a collective drive lighting inspection circuit of a liquid crystal display apparatus according to a fourth preferred embodiment.

FIG. 6 is a partially enlarged view of a collective drive lighting inspection circuit 12 of a liquid crystal display apparatus according to a fourth preferred embodiment. As shown in FIG. 6, the collective drive lighting inspection TFTs 25 are provided on the branched wires that connect each of the branch points of the connection wire 232 to each of the gate wires 2. In the fourth preferred embodiment, the plurality of collective drive lighting inspection TFTs 25 corresponding to the gate wires 2 have different channel widths. Here, as shown in FIG. 6, collective drive lighting inspection TFTs 25*a* closer to each of the collective drive lighting inspection terminals 20 have a channel width of W1, and collective drive lighting inspection TFTs 25*b* far from each of the collective drive lighting inspection terminals 20 have a channel width of W2. At this time, W1 and W2 are determined such that W1 is smaller than or equal to W2 (W1≤W2). The reason is that the collective drive lighting inspection TFTs 25*a* are set to have a resistance value during ON time greater than a resistance value during the ON time of the collective drive lighting inspection TFTs 25*b*.

This configuration causes the collective drive lighting inspection TFTs 25*a* on the side closer to the collective drive lighting inspection terminals 20 to have the relatively great resistance value during the ON time and causes the collective drive lighting inspection TFTs 25*b* on the farther side to have the relatively small resistance value during the ON time. This configuration can correct distribution of a resistance in the connection wires 232, allowing for a reduction in distribution of a resistance in a panel of the wires of the collective drive lighting inspection circuit 12 that inputs the gate signals from the collective drive lighting inspection terminals 20 to the display region 50. In addition, as shown in FIG. 6, the collective drive lighting inspection TFTs 25*a* adjacent to each other do not have different channel widths in particular, and the collective drive lighting inspection TFTs 25*b* adjacent to each other do not have different channel widths in particular. In other words, all of the collective drive lighting inspection TFTs 25 do not need to have the different channel widths, namely, the different resistance values during the ON time, which may be different by group, for example. On the contrary, all of the collective drive lighting inspection TFTs 25 may have gradually different channel widths, namely, gradually different resistance values during the ON time according to a distance from the collective drive lighting inspection terminals 20.

In addition, FIG. 6 does not show the lead-out wires 231, but FIG. 6 shows the same configuration as the configuration described in any of the first preferred embodiment (FIG. 2), the second preferred embodiment (FIG. 3), the third preferred embodiment (FIG. 4), and the modification of the third preferred embodiment (FIG. 5).

<Effects>

The liquid crystal display apparatus in the fourth preferred embodiment further includes the plurality of collective drive lighting inspection thin-film transistors 25 each located between the connection wire 232, 242 included in each of the first wire and the second wire and each of the plurality of gate wires 2 or each of the plurality of source wires 5 connected to the connection wire 232, 242. Part of the plurality of collective drive lighting inspection thin-film transistors 25 have the resistance value during the ON time different in magnitude from the resistance value during the ON time of the other collective drive lighting inspection thin-film transistors 25. Among the plurality of collective drive lighting inspection thin-film transistors 25, a collective drive lighting inspection thin-film transistor 25 having a shorter wiring path to the lead-out wire 231 included in the first wire has a resistance value during the ON time greater than or equal to a resistance value during the ON time of a collective drive lighting inspection thin-film transistor 25 having a longer wiring path to the lead-out wire 241. Among the plurality of collective drive lighting inspection thin-film transistors 25, a collective drive lighting inspection thin-film transistor 25 having a shorter wiring path to the lead-out wire 241 included in the second wire has a resistance value during the ON time greater than or equal to a resistance value during the ON time of a collective drive lighting inspection thin-film transistor 25 having a longer wiring path to the lead-out wire 241.

Therefore, in the collective drive lighting inspection circuit 12 corresponding to the gate wires 2, the collective drive lighting inspection TFTs 25*a* on the side closer to the collective drive lighting inspection terminals 20 (namely, on the side closer to the lead-out wires 231) are designed to have the relatively great resistance value during the ON time, and the collective drive lighting inspection TFTs 25*b* on the farther side are designed to have the relatively small resistance value during the ON time. This can correct the distribution of the resistance in the connection wires 232, allowing for the reduction in the distribution of the resistance in the panel of the wires of the collective drive lighting inspection circuit 12 that inputs the gate signals from the collective drive lighting inspection terminals 20 to the display region 50. Similarly, in the collective drive lighting inspection circuit 12 corresponding to the source wires 5, the collective drive lighting inspection TFTs 25 on the side closer to the collective drive lighting inspection terminals 20 (namely, on the side closer to the lead-out wires 241) are designed to have the relatively great resistance value during the ON time, and the collective drive lighting inspection TFTs 25 on the farther side are designed to have the relatively small resistance value during the ON time. This can correct the distribution of the resistance in connection wires 242, allowing for the reduction in the distribution of the resistance in the panel of the wires of the collective drive lighting inspection circuit 12 that inputs the gate signals from the collective drive lighting inspection terminals 20 to the display region 50.

In the liquid crystal display apparatus in the fourth preferred embodiment, the plurality of collective drive lighting inspection thin-film transistors 25 (25*a*, 25*b*) have different channel widths to have different resistance values during the ON time in magnitude.

Therefore, as the plurality of collective drive lighting inspection TFTs 25 get closer to the lead-out wires 231, the plurality of collective drive lighting inspection TFTs 25 have the gradually small channel width, so that the collective drive lighting inspection TFTs 25*a* on the side close to the collective drive lighting inspection terminals 20 can have the relatively great resistance value during the ON time while the collective drive lighting inspection TFTs 25*b* on the farther side can have the relatively small resistance value during the ON time. In comparison with a means of adjusting a resistance by a wire itself having a low resistance, the means of adjusting the resistance by the collective drive lighting inspection TFTs 25 used in the fourth preferred embodiment can adjust a resistance value in a wide range in a relatively small installation region. The means is thus suitable to be used as a means of adjusting the resistance in the collective drive lighting inspection circuit 12 under the constraint that the collective drive lighting inspection circuit 12 needs to be disposed in a small region. Furthermore, materials do not particularly need to be changed, so that a manufacturing cost is not increased by adding new manufacturing steps.

Fifth Preferred Embodiment

Figure 7:
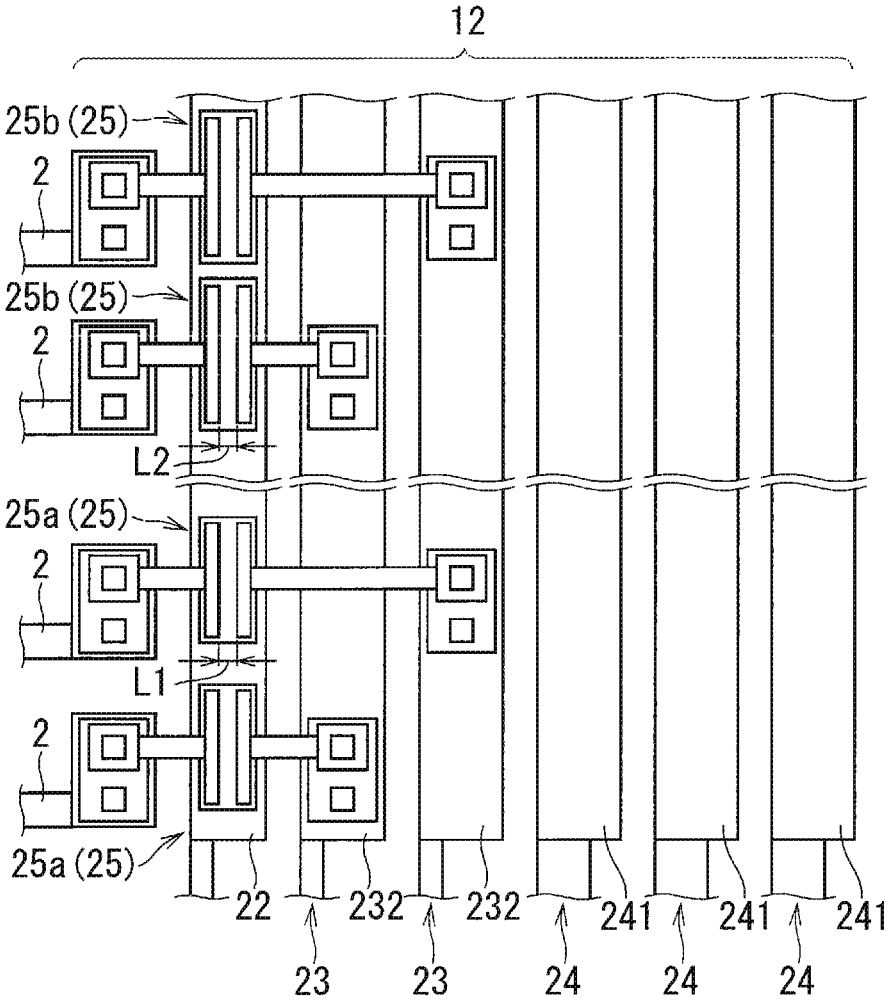
FIG. 7 is a partially enlarged view of a collective drive lighting inspection circuit of a liquid crystal display apparatus according to a fifth preferred embodiment.

FIG. 7 is a partially enlarged view of a collective drive lighting inspection circuit 12 of a liquid crystal display apparatus according to a fifth preferred embodiment. As shown in FIG. 7, the collective drive lighting inspection TFTs 25 are provided on the branched wires that connect each of the branch points of the connection wire 232 to each of the gate wires 2. In the fifth preferred embodiment, the plurality of collective drive lighting inspection TFTs 25 corresponding to the gate wires 2 have different channel lengths. Here, as shown in FIG. 7, collective drive lighting inspection TFTs 25*a* closer to each of the collective drive lighting inspection terminals 20 have a channel length of L1, and collective drive lighting inspection TFTs 25*b* far from each of the collective drive lighting inspection terminals 20 have a channel length of L2. At this time, L1 and L2 are determined such that L1 is greater than or equal to L2 (L1≥L2). The reason is that the collective drive lighting inspection TFTs 25*a* are set to have a resistance value during ON time greater than a resistance value during the ON time of the collective drive lighting inspection TFTs 25*b*.

This configuration causes the collective drive lighting inspection TFTs 25*a* on the side closer to the collective drive lighting inspection terminals 20 to have the relatively great resistance value during the ON time and causes the collective drive lighting inspection TFTs 25*b* on the farther side to have the relatively small resistance value during the ON time. This configuration can correct distribution of the resistance in the connection wires 232, allowing for a reduction in distribution of a resistance in a panel of the wires of the collective drive lighting inspection circuit 12 that inputs the gate signals from the collective drive lighting inspection terminals 20 to the display region 50. Similarly to the fourth preferred embodiment, the collective drive lighting inspection TFTs 25*a* adjacent to each other do not need to have different channel lengths in particular, and the collective drive lighting inspection TFTs 25*b* adjacent to each other do not need to have different channel lengths in particular. In other words, all of the collective drive lighting inspection TFTs 25 do not need to have the different channel lengths, namely, the different resistance values during the ON time, which may be different by group, for example. On the contrary, all of the collective drive lighting inspection TFTs 25 may have gradually different channel lengths, namely, gradually different resistance values during the ON time according to a distance from the collective drive lighting inspection terminals 20.

In addition, FIG. 7 does not show lead-out wires 231, but FIG. 7 shows the same configuration as the configuration described in any of the first preferred embodiment (FIG. 2), the second preferred embodiment (FIG. 3), the third preferred embodiment (FIG. 4), and the modification of the third preferred embodiment (FIG. 5).

<Effects>

In the liquid crystal display apparatus in the fifth preferred embodiment, the plurality of collective drive lighting inspection thin-film transistors 25 have different channel lengths to have different resistance values during the ON time in magnitude.

Therefore, as the plurality of collective drive lighting inspection TFTs 25 get closer to the lead-out wires 231, the plurality of collective drive lighting inspection TFTs 25 have the gradually great channel length, so that the collective drive lighting inspection TFTs 25*a* on the side close to the collective drive lighting inspection terminals 20 can have the relatively great resistance value during the ON time while the collective drive lighting inspection TFTs 25*b* on the farther side can have the relatively small resistance value during the ON time. This configuration can correct the distribution of the resistance in the connection wires 232, allowing for the reduction in the distribution of the resistance in the panel of the wires of the collective drive lighting inspection circuit 12 that inputs the gate signals from the collective drive lighting inspection terminals 20 to the display region 50. In comparison with a means of adjusting a resistance by a wire itself having a low resistance, the means of adjusting the resistance by the collective drive lighting inspection TFTs 25 used in the fifth preferred embodiment can adjust a resistance value in a wide range in a relatively small installation region. The means is thus suitable to be used as a means of adjusting the resistance in the collective drive lighting inspection circuit 12 under the constraint that the collective drive lighting inspection circuit 12 needs to be disposed in a small region. Furthermore, materials do not particularly need to be changed, so that a manufacturing cost is not increased by adding new manufacturing steps.

In addition, according to the present invention, the above preferred embodiments can be arbitrarily combined, or each preferred embodiment can be appropriately varied or omitted within the scope of the invention.

While the invention has been shown and described in detail, the foregoing description is in all aspects illustrative and not restrictive. It is therefore understood that numerous modifications and variations can be devised without departing from the scope of the invention.

What is claimed is:

1. A liquid crystal display apparatus including a display region that displays an image and a frame region that surrounds said display region, said liquid crystal display apparatus comprising:

a plurality of gate wires arranged in parallel in said display region;

a plurality of source wires that are arranged in parallel in said display region and intersect said plurality of gate wires;

a plurality of collective drive lighting inspection terminals for inspecting the liquid crystal display apparatus, said plurality of collective drive lighting inspection terminals located in said frame region; and a plurality of collective drive lighting inspection signal input wires that is located in said frame region and electrically connects said plurality of collective drive lighting inspection terminals to said plurality of gate wires and said plurality of source wires, wherein said plurality of collective drive lighting inspection signal input wires includes a first wire corresponding to said gate wires and a second wire corresponding to said source wires, said first wire and said second wire each include a connection wire and a lead-out wire, said connection wire including branch points connected to each of said plurality of gate wires or each of said plurality of source wires, said lead-out wire being led out from said connection wire to one of said plurality of collective drive lighting inspection terminals, and said lead-out wire included in said first wire or said lead-out wire included in said second wire includes a high-resistance region having a resistivity greater than a resistivity of said connection wire connected to said lead-out wire.

2. The liquid crystal display apparatus according to claim 1, further comprising a plurality of gate wire lead-out wires that electrically connect a gate wire driving circuit to ends of said plurality of gate wires, said gate wire driving circuit generating a drive signal to said gate wires during a normal drive, said ends being opposite to the side connected to said first wire, wherein said lead-out wire included in said first wire includes said high-resistance region, and said first wire including said high-resistance region has a wiring resistance greater than a minimum value of a wiring resistance of each of said plurality of gate wire lead-out wires.

3. The liquid crystal display apparatus according to claim 2, wherein said first wire including said high-resistance region has the wiring resistance smaller than a maximum value of the wiring resistance of each of said plurality of gate wire lead-out wires.

4. The liquid crystal display apparatus according to claim 1, wherein said high-resistance region included in said lead-out wire is a region having a wiring width narrower than that of said connection wire connected to said lead-out wire.

5. The liquid crystal display apparatus according to claim 4, wherein said lead-out wire included in said first wire includes said high-resistance region, and said high-resistance region of said lead-out wire included in said first wire is a region having the wiring width narrower than that of said lead-out wire included in said second wire.

6. The liquid crystal display apparatus according to claim 1, wherein said high-resistance region included in said lead-out wire is a region in which a slit is provided in said lead-out wire.

7. The liquid crystal display apparatus according to claim 1, wherein said high-resistance region included in said lead-out wire includes a wire in a zigzag pattern.

8. The liquid crystal display apparatus according to claim 1, wherein said high-resistance region included in said lead-out wire is a connection converter that connects said lead-out wire to said connection wire included in said first wire or said second wire.

9. The liquid crystal display apparatus according to claim 1, wherein said high-resistance region included in said lead-out wire comprises a material having a resistivity greater than that of said connection wire connected to said lead-out wire.

10. The liquid crystal display apparatus according to claim 1, further comprising a plurality of collective drive lighting inspection thin-film transistors each located between said connection wire included in each of said first wire and said second wire and each of said plurality of gate wires or each of said plurality of source wires connected to said connection wire, wherein part of said plurality of collective drive lighting inspection thin-film transistors have a resistance value during ON time different in magnitude from a resistance value during the ON time of the other collective drive lighting inspection thin-film transistors, among said plurality of collective drive lighting inspection thin-film transistors, a collective drive lighting inspection thin-film transistor having a shorter wiring path to said lead-out wire included in said first wire has a resistance value during the ON time greater than or equal to a resistance value during the ON time of a collective drive lighting inspection thin-film transistor having a longer wiring path to said lead-out wire, and among said plurality of collective drive lighting inspection thin-film transistors, a collective drive lighting inspection thin-film transistor having a shorter wiring path to said lead-out wire included in said second wire has a resistance value during the ON time greater than or equal to a resistance value during the ON time of a collective drive lighting inspection thin-film transistor having a longer wiring path to said lead-out wire.

11. The liquid crystal display apparatus according to claim 10, wherein said plurality of collective drive lighting inspection thin-film transistors have different channel widths to have different resistance values during the ON time in magnitude.

12. The liquid crystal display apparatus according to claim 10, wherein said plurality of collective drive lighting inspection thin-film transistors have different channel lengths to have different resistance values during the ON time in magnitude.

* * * * *